US007155143B2

(12) United States Patent
Miner et al.

(10) Patent No.: US 7,155,143 B2
(45) Date of Patent: Dec. 26, 2006

(54) SILENCER FOR AN IMAGING DEVICE PHOTORECEPTOR

(75) Inventors: Russell B. Miner, Ontario, NY (US); William G. Herbert, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/984,795

(22) Filed: Nov. 10, 2004

(65) Prior Publication Data

US 2006/0099010 A1 May 11, 2006

(51) Int. Cl.
*G03G 15/00* (2006.01)

(52) U.S. Cl. ..... 399/159

(58) Field of Classification Search ..... 399/159
See application file for complete search history.

(56) References Cited

U.S. PATENT DOCUMENTS 4,914,478 A 4/1990 Yashiki
5,357,321 A 10/1994 Stenzel et al.
5,461,464 A 10/1995 Swain
5,630,196 A 5/1997 Swain
5,815,773 A 9/1998 Zaman
5,991,573 A * 11/1999 Nohsho et al. ..... 399/159
6,246,851 B1 6/2001 Tietze et al.
6,400,914 B1 * 6/2002 Noda et al. ..... 399/90
2003/0231900 A1 * 12/2003 Toriyama et al. ..... 399/159
2004/0042822 A1 * 3/2004 Fujishiro et al. ..... 399/159

FOREIGN PATENT DOCUMENTS

JP 05035167 A * 2/1993
JP 08146637 A * 6/1996
JP 09026728 A * 1/1997
JP 10186700 A * 7/1998

* cited by examiner

*Primary Examiner*—Quana Grainger
(74) *Attorney, Agent, or Firm*—Oliff & Berridge, PLC

(57) ABSTRACT

A silencer secured to the inside of a drum, for example, by an adhesive, is directly attached to flanges on either end of the silencer and drum. The flanges may be attached to the silencer without the need for a compression fit, for example, by sonically welding the flanges to the end(s) of the silencer.

17 Claims, 4 Drawing Sheets

SILENCER FOR AN IMAGING DEVICE PHOTORECEPTOR

BACKGROUND

An exemplary embodiment relates to a silencer used in a photoreceptor of an imaging device.

Imaging devices having cylindrical photoreceptors (sometimes called photoreceptor drums) can incorporate flanges attached to ends of the drum for holding and driving the photoreceptor in a print engine of the imaging device. In such a photoreceptor, a silencer may be utilized to eliminate noise, such as, for example, blade squeak caused when, for example, a cleaning blade in the print engine rubs against the photoreceptor. Typically, silencers are plastic cylindrical forms that fit inside the photoreceptor drum. The silencers that fit inside the photoreceptor drum typically are held in place by friction. For example, a typical silencer is a plastic tube-like member having a longitudinal slit (so the silencer has a C-shaped cross-section), which allows the silencer tube to be compressed (e.g., radially squeezed), slid into the photoreceptor drum while in the compressed state, and then released so that the silencer tube expands and engages the internal surface of the photoreceptor drum by friction. The silencer basically reinforces the photoreceptor drum, and changes the resonance frequency of the drum so as to avoid the vibrations that generate blade squeak, for example. The flanges may then be adhesively secured to either end of the photoreceptor drum.

U.S. Pat. No. 6,246,851 discloses a cylindrical photo conductor drum which has a drum body. A flange is inserted with a snug fit (i.e., friction fit) on the front side of the cylindrical drum body. The dimensions of the drum body and flange must be precisely matched in the area of the snug fit resulting in the drum body and flange being self-fixed after assembly.

U.S. Pat. No. 5,815,773 discloses an end flange capable of translating a rotational force from an outside source to a hollow cylindrical member such as a photoreceptor drum. The end flange is mounted to the photoreceptor drum without the use of an adhesive material. In particular, the flange is forced into the inside of a photoreceptor such that an outer diameter of the flange will firmly contact the inside surface of the photoreceptor. Thus, an inner compression load is applied to the flange during and after assembly.

U.S. Pat. No. 5,630,196 discloses an end flange secured to at least one end of a hollow cylindrical photoreceptor drum by means of a partially wound coil spring. The spring has an inner end and an outer end, the inner end being secured to the end flange, and the outer end having an exposed arcuate outer surface in frictional contact with the inner surface of the hollow cylindrical photoreceptor drum.

U.S. Pat. No. 5,461,464 discloses a flange member engaged with an end section of a photoreceptor drum. The flange member includes a projection which fits into a surface hole (slot) located in the end section such that no adhesive is used between the engaging surfaces of the substrate and the flange member.

U.S. Pat. No. 5,357,321 discloses an end flange device which avoids the use of adhesive materials, in which resilient fingers of the flange device having pointed tips dig into and penetrate the inner surface of the photoreceptor drum.

SUMMARY

As noted above, silencers may be fitted into a photoreceptor drum, and held in place in the drum by friction, and the flanges may be secured to the drum by adhesive or other means, including friction. However, recycling of used photoreceptors having glued flanges is difficult, if not impossible, because of damage to the flanges and/or the photoreceptor during removal of the flanges from the photoreceptor. Such removal techniques can damage or destroy both the photoreceptor and the flange. Further, where disassembly is accomplished without damage, cleaning of both the flange and the photoreceptor drum is required to remove remaining adhesive. In addition, adhesive application equipment utilized during mounting of an end flange to a photoreceptor drum is difficult to maintain because the adhesive has a short life and often solidifies and clogs the equipment, thereby requiring time consuming efforts to clean and remove the solidified adhesive.

In addition, the adhesive may migrate to the outside of the drum and contaminate the photoreceptor surface.

Further, friction fit of the silencer into the drum requires compression forces on the drum, which may distort the drum and cause "out-of-round" defects, which adversely affect the image. Furthermore, the silencer must be manufactured for a precise fit which raises costs.

Thus, in a first exemplary embodiment, a silencer that substantially spans the length of the drum may be used. The silencer may be cut just long enough to contact flanges to be located on the ends of the drum. Preferably, adhesive may be used to secure the silencer to the inside of the drum. However, any commonly known or later developed method or device to achieve attachment of the silencer to the inside of the drum may be used.

In exemplary embodiments, the flanges may be attached directly to the silencer, without adhesive, for example, by welding the flanges to the ends of the silencer. Preferably, sonic welding is used. More preferably, ultrasonic welding is used. However, any commonly known or later developed method or device to achieve fusing of the flanges to the ends of the silencer may be used.

Thus, in exemplary embodiments, the silencer does not need to be machined to provide a compression fit with the inside of the drum, which reduces the cost of the silencer. Furthermore, the length of the silencer does not need to be highly precise because the process of welding the flanges to the ends of the silencer can accommodate a relatively wide variance in the length of the silencer, further reducing or minimizing the cost of the silencers. Accordingly, the manufacture of the silencer with respect to, for example, the drum diameter and length, need not be as precise as many of the related art carefully machined silencers because the described structure does not require an exact fit.

In exemplary embodiments, because the flanges are not adhesively secured to the photoreceptor drum (or to the silencer), adhesive does not need to be applied at the ends of the drum or silencer, and therefore adhesive should not migrate to the end of the drum and contaminate the photoreceptor surface.

Furthermore, absence of glue enables the possibility of using conductive material for the flanges, which may reduce, minimize or eliminate a need for ground strips, thereby providing material and process cost reductions.

Because there is not a need for the silencer of the exemplary embodiments to have a compression fit, distortion imparted to the photoreceptor drum with compression fit silencers may be reduced, minimized, or eliminated.

One exemplary embodiment allows for the use of a one-piece silencer instead of a multi-piece silencer, which reduces the number of parts that may need to be handled. However, it also is possible for the silencer to have more than one part. Furthermore, in the related art a single-piece silencer is used. The related single-piece silencer may be molded or machined to specific dimensions and may be used in, for example, any photoreceptor that has the same inside diameter. However, the single-piece silencer of the related art must be manufactured with specific dimensions in order to provide a snug fit for vibration dampening.

Therefore, one exemplary embodiment includes a single-piece silence that does not require precise dimensions and will therefore be less costly to manufacture. For example, a single-piece silencer, according to this exemplary embodiment, may be less expensive than a single-piece silencer of the related art due to the lack of need for precise dimensions.

Therefore, an exemplary embodiment includes a silencer attached to an end flange without using an adhesive or a compression fit. The silencer, in turn, is attached to the internal surface of the photoreceptor drum, such that the driving (rotating) forces imparted to one or both of the flanges are transmitted to the drum via the silencer.

Many alternatives, modifications, and variations of the exemplary embodiments are possible. For example, although in an exemplary embodiment flanges are ultrasonically welded to the silencer, it is envisioned that the flanges may be attached to the silencer by any commonly known or later developed method or device to achieve an attachment, preferably without the need for adhesives.

DETAILED DESCRIPTION OF EMBODIMENTS

An imaging device includes elements that contact the photoreceptor. For example, a blade might be used to remove any remaining toner that is stuck on the photoreceptor drum or to clean the drum. Consequently, whatever touches the photoreceptor may create vibration. If the frequency of the vibration is a resonance frequency, the photoreceptor or the blade itself may vibrate. Noise is a result of the vibration. In order to change the resonance frequency of the photoreceptor, silencers can be placed inside the photoreceptor drum.

Figure 1:
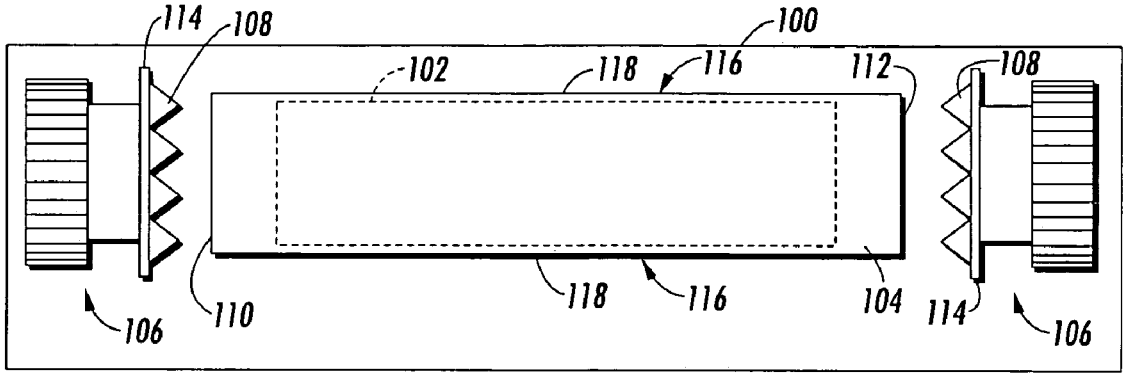
FIG. 1 illustrates a silencer in a photoreceptor drum in an exemplary embodiment.

FIG. 1 shows a photoreceptor system including such a silencer in an imaging device 100. A silencer 102 is located inside a photoreceptor drum (cylindrical substrate) 104. The silencer 102 may be a plastic tube or the like. The silencer 102 may be cylindrical and slightly smaller in its outer diameter and length than the inner diameter and length of the photoreceptor drum 104. The drum 104 may include a conductive metal tube, such as, for example, an aluminum tube or the like, coated with a photoreceptor material. See, for example, U.S. Pat. Nos. 5,815,773, 5,630,196, 5,461,464 and 5,357,321, each of which is incorporated herein by reference in its entirety.

Figure 2:
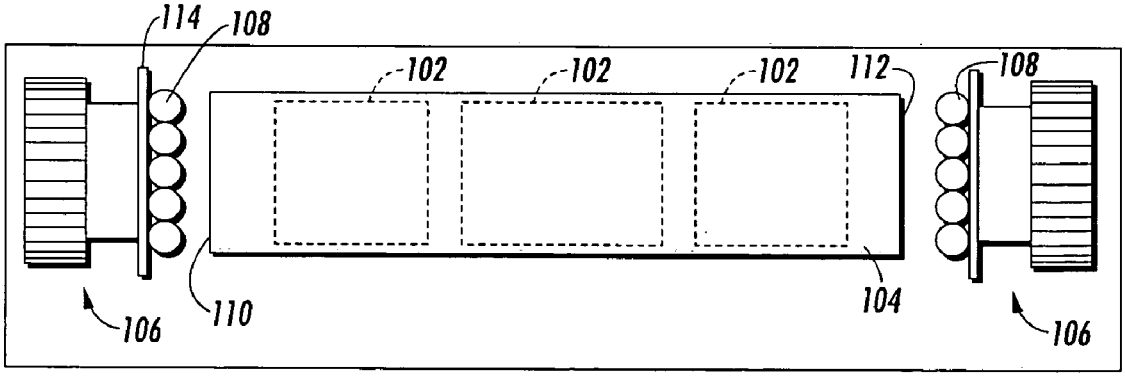
FIG. 2 illustrates a multi-piece silencer in a photoreceptor drum in an exemplary embodiment.

FIG. 2 shows a photoreceptor system with a multi-piece silencer 102. In an exemplary embodiment, multiple pieces for the silencer, for example, two or three pieces disposed along the length of the drum 104, within the drum 104, may be used. The multiple pieces may or may not be in contact with each other. Furthermore, it may not be necessary for the silencer 102 to span the entire length of the substrate 104. Instead, a single, shorter silencer 102 may be centered in the substrate 104.

Whether or not a single-piece silencer or a multiple-piece silencer is used is dependent on the type of imaging device or other device in which the silencer 102 is to be used. Some devices may only require a single-piece silencer, other devices may require two or three-piece silencers. In one exemplary embodiment, the silencer may be about 3 inches long so that one, two, three-piece or more silencers may be used in the device depending on the requirements of the device. However, the cost of the silencer may increase with each additional piece, and thus the fewer pieces used, the lower the cost, in general.

The need for a multiple-piece silencer and the number of required pieces depends on many variables. Such variables may include, for example, how firmly the device holds the drum (i.e., photoreceptor), the nature of the interfacing surfaces between the flanges and the device that contacts the flanges, the speed of rotation of the drum, the type of material used for a blade that may contact the drum, the pressure that is applied to the blade, the operating temperature of the device, and the like.

However, in one exemplary embodiment, a single-piece silencer 102 that substantially spans the length of the drum 104 is provided, and is adhesively attached to the inside of the drum 104, as shown in FIG. 1.

As further illustrated in FIGS. 1 and 2, flanges 106 each having weld features 108 are inserted at a first end 110 and/or at a second end 112 of the drum 104.

As shown in FIGS. 1–5, the weld features 108 may be formed in various shapes and sizes. The weld features 108 may be manufactured of any material that can be fused (e.g., by sonic welding) to the material that constitutes the silencer 102. For example, the flange 106, including the weld features 108, can be made from the same material as the silencer 102. The flange 106, weld features 108, and silencer 102 may be made from polycarbonite, acetal, and the like. In an exemplary embodiment, polycarbonite may be used due to its strength, thermal stability and low shrinkage during molding. It is envisioned that any material having any or all of these characteristics may be used. It also is possible for the weld features 108 to be made from a different material than the silencer 102.

Referring again to FIGS. 1 and 2, the flanges 106 may include a ground strip 114 to ground the drum 104. The ground strip 114 of the flanges 106 facilitates an electrical contact of an outer surface 116 of the drum 104 to a cartridge (not shown) in which the drum 104 is installed. The ground strip 114 may be, for example, a copper plate or other conductive material.

Figure 3:
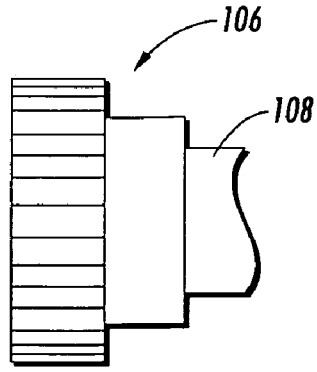
FIG. 3 illustrates a first type of flange in an exemplary embodiment.
Figure 4:
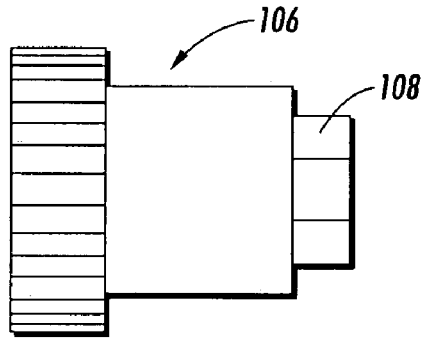
FIG. 4 illustrates a second type of flange in an exemplary embodiment.
Figure 5:
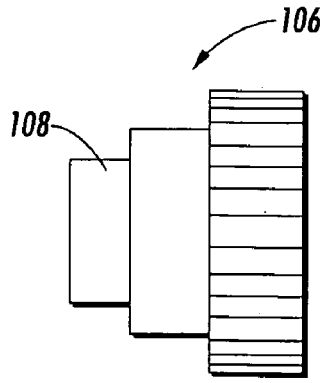
FIG. 5 illustrates a third type of flange in an exemplary embodiment.

Alternatively, as shown in FIGS. 3–5, the flanges 106 may not have a ground strip 114. For example, the flanges 106 may be a carbon filled plastic, a conductive plastic, a metal, or the like, reducing, minimizing or eliminating the need for a ground strip 114.

Figure 6:
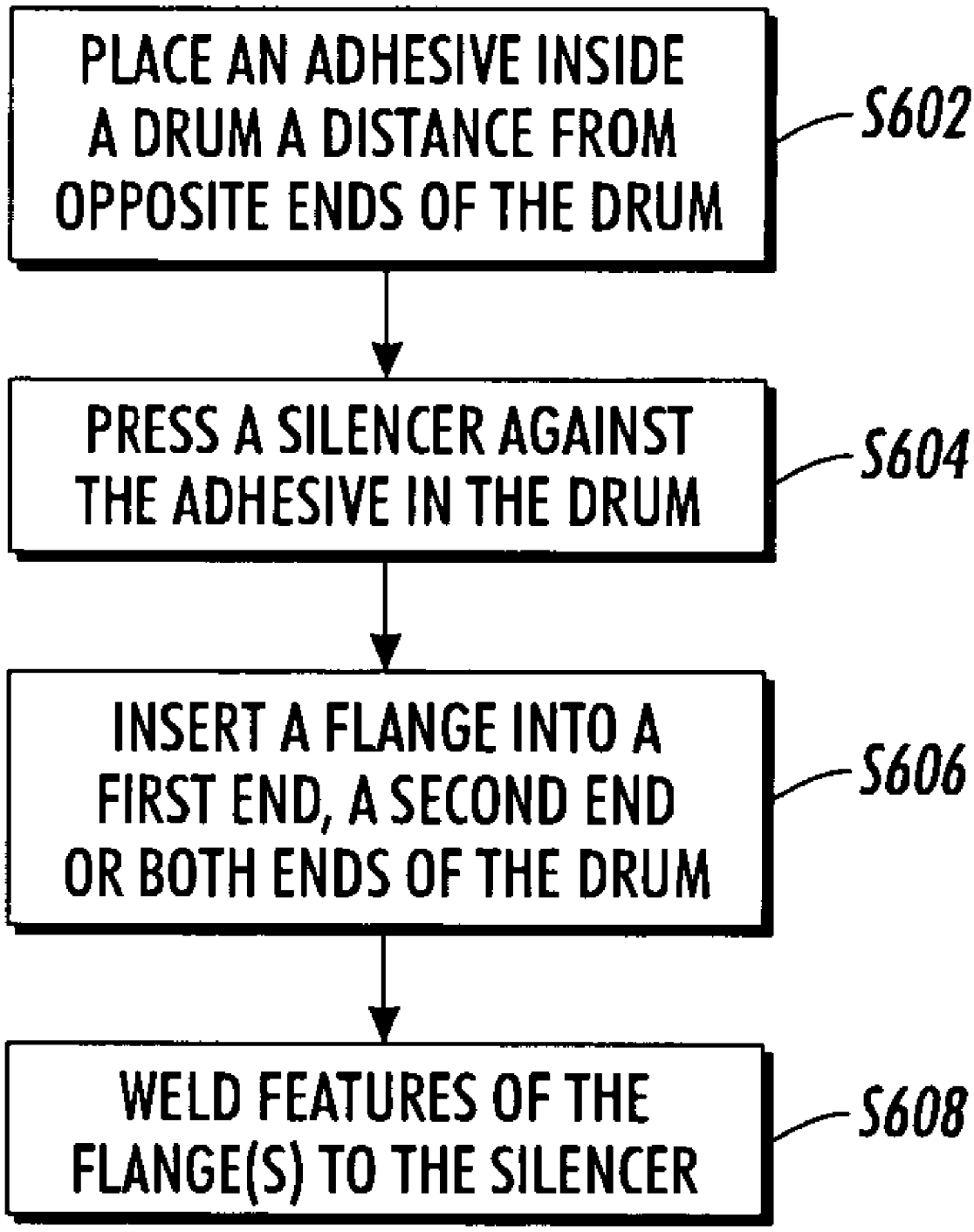
FIG. 6 is a flowchart of a method of assembling a photoreceptor drum assembly in an exemplary embodiment.

Referring to FIG. 6, one exemplary method for assembling the silencer in an imaging device is illustrated. The silencer 102 is secured to the drum 104 by placing an adhesive 118 within the drum 104. Preferably the adhesive 118 is placed a distance from both the first end 110 and the second end 112 of the drum, as shown at step S602. The adhesive 118 may be placed sufficiently far enough away from either end 110, 112 to ensure that the adhesive does not migrate to the flanges 106, and especially not to the outer surface 116 of the drum 104, or to the ground strip 114.

The silencer 102 may be pressed against the adhesive 118 to secure the silencer 102 within the drum 104, as shown at step S604. Because the outer diameter of the silencer 102 is slightly smaller than the inner diameter of the drum 104, the silencer 102 easily slides into the drum 104 without deforming the shape of the drum 104. The adhesive fills the space between the silencer 102 and an inner surface of the drum 104, and once cured, rigidly bonds the silencer 102 to the drum 104. After the silencer 102 is secured to the inside of the drum 104, one of the flanges 106 may be inserted into the first end 110, or the second end 112, or flanges 106 may be inserted into each of the first end 110 and the second end 112 of the drum 104, as shown at step S606. The weld features 108 may then be welded to the silencer 102, as shown at step S608. Preferably, the weld features 108 are sonically welded to the silencer 102, and more preferably, ultrasonically welded to the silencer 102. This welding process consists of applying force, pressure and vibration to the flange(s) at the same time to melt the weld features to the silencer 102.

Figure 7:
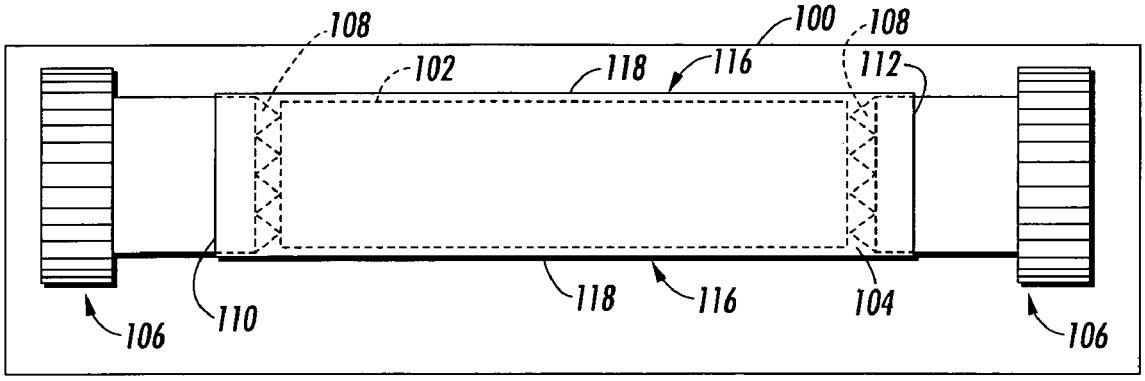
FIG. 7 illustrates a silencer in a photoreceptor drum, wherein the silencer is directly attached to flanges on either end of the photoreceptor drum, in an exemplary embodiment.

The silencer 102 is positioned within the drum 104 such that the weld features 108 of the flanges will contact the end of the silencer 102. See FIG. 7. However, because the weld features 108 melt during the welding process, it is not necessary for the silencer and flanges to be made with high tolerances with respect to their lengths (in the longitudinal direction of the drum 104). Thus the cost of the silencer and flanges can be reduced. The silencer 102 and flanges merely need to be long enough so that they will contact each other, and there is a relatively wide range for the tolerance before one of the members is considered to be too long.

While it is preferred that the silencer 102 is adhesively bonded to the inner surface of the drum, other means for attaching the silencer to the drum are possible. For example, a compression/friction fit between the silencer and drum also could be used, although such a construction may cause the drum to become out-of-round, and/or may not couple the silencer to the drum in a strong enough manner to avoid slippage between the silencer and drum when the gear on the flange is driven. In addition, a mechanical coupling could be provided between the silencer and the drum, although this may be more costly than using adhesive.

As noted above, the flanges preferably are sonically welded to the end of the silencer. The welding can be ultrasonic welding or other forms of sonic welding. Any technique that rigidly and directly attaches the flange to the silencer can be used, such as, for example, adhesive. Because the flanges are attached to the ends of the silencer inside of the drum 104 (i.e., spaced from the ends of the drum), there is a greatly reduced possibility that adhesive could migrate to the photoreceptor surface, compared to when the flanges are adhesively attached to the ends of the drum 104.

In the illustrated embodiments, both of the flanges include gear teeth on their outer surfaces for engagement with one or more gears of the print engine drive system. It also is possible for only one of the flanges to include gear teeth. In addition, the gear teeth can be provided on a structure other than the flange(s), which structure is then secured to the flange(s).

The photoreceptor system can be used with various imaging devices 100 including, for example, printers, facsimile machines, copiers, multi-function devices that perform a combination of the functions of a printer, facsimile machine and/or copier. The exemplary embodiments encompass such devices, and other devices, which include a photoreceptor.

Many alternatives, modifications and variations of the exemplary embodiments will be apparent to those skilled in the art. For example, variations of the exemplary embodiments may involve different shapes and proportions of the main features of the described devices. Accordingly, the preferred embodiments, as set forth above, are intended to be illustrative and not limiting. Various changes may be made without departing from the spirit and scope of the exemplary embodiments.

What is claimed is:

1. A photoreceptor system, comprising:

a photoreceptor drum having a first end and a second end;

at least one silencer disposed inside the photoreceptor drum, the silencer having a first end and a second end;

a first flange disposed at the first end of the photoreceptor drum; and a second flange disposed at the second end of the photoreceptor drum, the first flange is directly attached to the first end of the silencer, the second flange is directly attached to the second end of the silencer, and the silencer is attached by an adhesive to an inner surface of the photoreceptor drum, wherein the adhesive on the inner surface of the photoreceptor drum is spaced from the first end and the second end of the photoreceptor drum.

2. The system of claim 1, wherein the first and second flanges are respectively sonically welded to the first and second ends of the silencer.

3. The system of claim 1, wherein the first and second flanges are respectively ultrasonically welded to the first and second ends of the silencer.

4. The system of claim 1, further comprising:

a ground strip attached to at least one of the first flange and the second flange, wherein the ground strip is metal, and the ground strip contacts the photoreceptor drum.

5. The system of claim 1, wherein the first flange and the second flange are made from a conductive material and contact the photoreceptor drum.

6. The system of claim 1, wherein the photoreceptor drum includes an aluminum tube.

7. The system of claim 1, wherein a length of the silencer is substantially the same as a length of the photoreceptor drum.

8. The system of claim 1, further comprising:

welding features attached to at least one of the first flange and the second flange for welding the flange to the silencer.

9. The system of claim 1, wherein the silencer is a plastic cylindrical tube.

10. The system of claim 1, wherein the silencer is a plurality of tubes.

11. The system of claim 1, wherein the first and second flanges are attached to the silencer without adhesive.

12. The system of claim 1, wherein at least one of the first flange and the second flange includes gear teeth on a surface of the flange.

13. An image forming device including the photoreceptor of claim 1.

14. A method of making a photoreceptor system, the method comprising:

inserting a silencer inside of a photoreceptor drum, wherein the silencer is a plurality of tubes;

adhesively attaching the silencer to the inside of the photoreceptor drum, wherein the photoreceptor drum has a first end and a second end, and wherein the adhesive on the inside of the photoreceptor drum is spaced from the first end and the second end of the photoreceptor drum;

placing a flange at an end of the photoreceptor drum; and directly attaching at least a part of the flange to an end of the silencer.

15. The method of claim 14, wherein the flange is a first flange, and further comprising:

placing a second flange at an opposite end of the photoreceptor drum, which is opposite to the end at which the first flange is placed, and directly attaching the second flange to the silencer.

16. The method of claim 14, further comprising:

grounding the photoreceptor drum by providing a ground strip between the flange and the photoreceptor drum.

17. A photoreceptor system comprising:

a photoreceptor drum having a first end and a second end;

at least one silencer having a first end and a second end, the silencer disposed inside the photoreceptor drum;

means for adhesively attaching the silencer to the inside of the photoreceptor drum, wherein the means for adhesively attaching the silencer to the inside of the photoreceptor drum includes providing an adhesive on the inside of the photoreceptor drum, the adhesive being spaced from the first end and the second end of the photoreceptor drum;

a first flange disposed at the first end of the photoreceptor drum and a second flange disposed at the second end of the photoreceptor drum; and means for directly attaching the first flange to the first end of the silencer and the second flange to the second end of the silencer.

* * * * *